US010109437B1

(12) United States Patent
Li et al.

(10) Patent No.: US 10,109,437 B1
(45) Date of Patent: Oct. 23, 2018

(54) KEY SOUND GENERATION DEVICE FOR SILICONE KEYBOARD

(71) Applicant: Rongshu Li, Dongguan (CN)

(72) Inventors: Rongshu Li, Dongguan (CN); Changshun Fang, Dongguan (CN)

(73) Assignee: Rongshu Li, Dongguan, Guangdong Province (CN)

( * ) Notice: Subject to any disclaimer, the term of this patent is extended or adjusted under 35 U.S.C. 154(b) by 0 days.

(21) Appl. No.: 15/487,440

(22) Filed: Apr. 14, 2017

(51) Int. Cl.
*H01H 13/85* (2006.01)
*H01H 13/14* (2006.01)

(52) U.S. Cl.
CPC ..... *H01H 13/85* (2013.01); *H01H 13/14* (2013.01); *H01H 2215/03* (2013.01)

(58) Field of Classification Search
CPC ..... H01H 13/85; H01H 2215/03
USPC ..... 200/308
See application file for complete search history.

(56) References Cited

U.S. PATENT DOCUMENTS 5,004,880 A * 4/1991 Koutaka ..... H01H 13/14 200/308
9,620,308 B1 * 4/2017 Li ..... H01H 13/85
9,767,970 B2 * 9/2017 Jhuang ..... H01H 13/023

* cited by examiner

*Primary Examiner* — Felix O Figueroa
(74) *Attorney, Agent, or Firm* — Leong C. Lei

(57) ABSTRACT

A key sound generation device for a silicone keyboard includes a seat and a press block. The seat or the press block is provided with a torsion spring. The press block is biased by the torsion spring to move up so that the product provides better handfeel. Meanwhile, when the press block is pressed or released, the torsion spring hits the seat or the press block to produce a sound, providing a better auditory effect.

6 Claims, 7 Drawing Sheets

KEY SOUND GENERATION DEVICE FOR SILICONE KEYBOARD

FIELD OF THE INVENTION

The present invention relates to a key, and more particularly to a key sound generation device for a silicone keyboard.

BACKGROUND OF THE INVENTION

There are two types of keyboards on the market, namely, a mechanical switch and a photoelectric switch. The photoelectric switch uses the photoelectric coupling technology instead of the mechanical contact structure, which uses the optical principle and the photoelectric coupling technology. An infrared transmitting tube cooperates with an infrared receiving tube to form a light path. A light blocking member is provided for connection and disconnection of the light path to change the circuit impedance to control the photoelectric switch's "ON/OFF" state. Compared to other keyboards, the photoelectric switch has a longer service life and the handfeel of the keyboard would not change after long-term using.

Although mechanical switches have the drawbacks of elastic fatigue after long-term using, the mechanical switches are now widely used in a variety of switches because they provide accurate energy conversion control characteristics. The open and closed state of the key switch is judged by the visual effect only. A sound button is developed accordingly through the auditory effect to judge its open and closed state. However, this sound button is achieved by using an elastic sheet. When pressed, the anti-fatigue of the elastic sheet is still weak, and the mold precision requirements are very high. When the elastic sheet is pressed a certain times, the metal of the elastic sheet fatigues. As a result, the handfeel and the sound of the keyboard are different from a new one. The touch of the button is not obvious, which is inconvenient for use.

Accordingly, the inventor of the present invention has devoted himself based on his many years of practical experiences to solve these problems.

SUMMARY OF THE INVENTION

In view of the shortcomings of the prior art, the primary object of the present invention is to provide a key sound generation device for a silicone keyboard which has a long service life and provides better handfeel and auditory effect.

In order to achieve the aforesaid object, the key sound generation device for a silicone keyboard of the present invention comprises a seat and a press block. The press block is movably insertedly mounted in the seat. The seat includes a silicone rubber member therein for pushing the press block to move up and down. The seat or the press block is provided with a torsion spring for pushing the press block to move up and for hitting the seat or the press block to produce a sound.

Preferably, the seat is formed with a through hole penetrating upper and lower surfaces thereof. The press block is located in the through hole. An inner wall of the through hole is provided with a holding portion. A bottom of the press block is formed with a spring room. The press block has a hit portion therein. The hit portion and the spring room are located at two sides of the holding portion, respectively. The torsion spring includes a main body portion, a drive arm, and a driven arm. The main body portion is connected between the drive an and the driven arm. The main body portion and the driven arm are placed in the spring room. The drive arm leans against the holding portion. A distal end of the drive arm is located above the hit portion.

Preferably, the inner wall of the through hole is provided with a guide limit recess. An outer wall of a lower end of the press block is provided with a raised guide limit portion. The guide limit portion is located in the guide limit recess and moved up and down along the guide limit recess.

Preferably, one side of the press block is provided with a positioning groove. The holding portion passes through the positioning groove and extends into the press block. The holding portion is moved up and down along the positioning groove.

Alternatively, the seat is formed with a through hole penetrating upper and lower surfaces thereof. The seat is provided with a spring room and a hit portion. The press block is located in the through hole. An outer wall of the press block is provided with a holding portion. The spring room and the hit portion are located at two sides of the holding portion, respectively. The torsion spring includes a main body portion, a drive arm, and a driven arm. The main body portion is connected between the drive arm and the driven arm. The main body portion and the driven arm are placed in the spring room. The drive arm leans against a bottom surface of the holding portion. A distal end of the drive arm is located under the hit portion.

Preferably, an inner wall of the through hole is provided with a guide limit recess. An outer wall of a lower end of the press block is provided with a raised guide limit portion. The guide limit portion is located in the guide limit recess and moved up and down along the guide limit recess.

Preferably, one side of the seat is provided with a positioning groove. The holding portion passes through the positioning groove and extends out of the seat. The holding portion is moved up and down along the positioning groove.

Compared to the prior art, the present invention has obvious advantages and beneficial effects. The seat or the press block is provided with the torsion spring. The press block is biased by the torsion spring to move up so that the product provides a better touch feeling. Meanwhile, when the press block is pressed or released, the torsion spring hits the seat or the press block to produce a sound, providing a better auditory effect. It is more convenient for use.

DETAILED DESCRIPTION OF THE PREFERRED EMBODIMENTS

Figure 1:
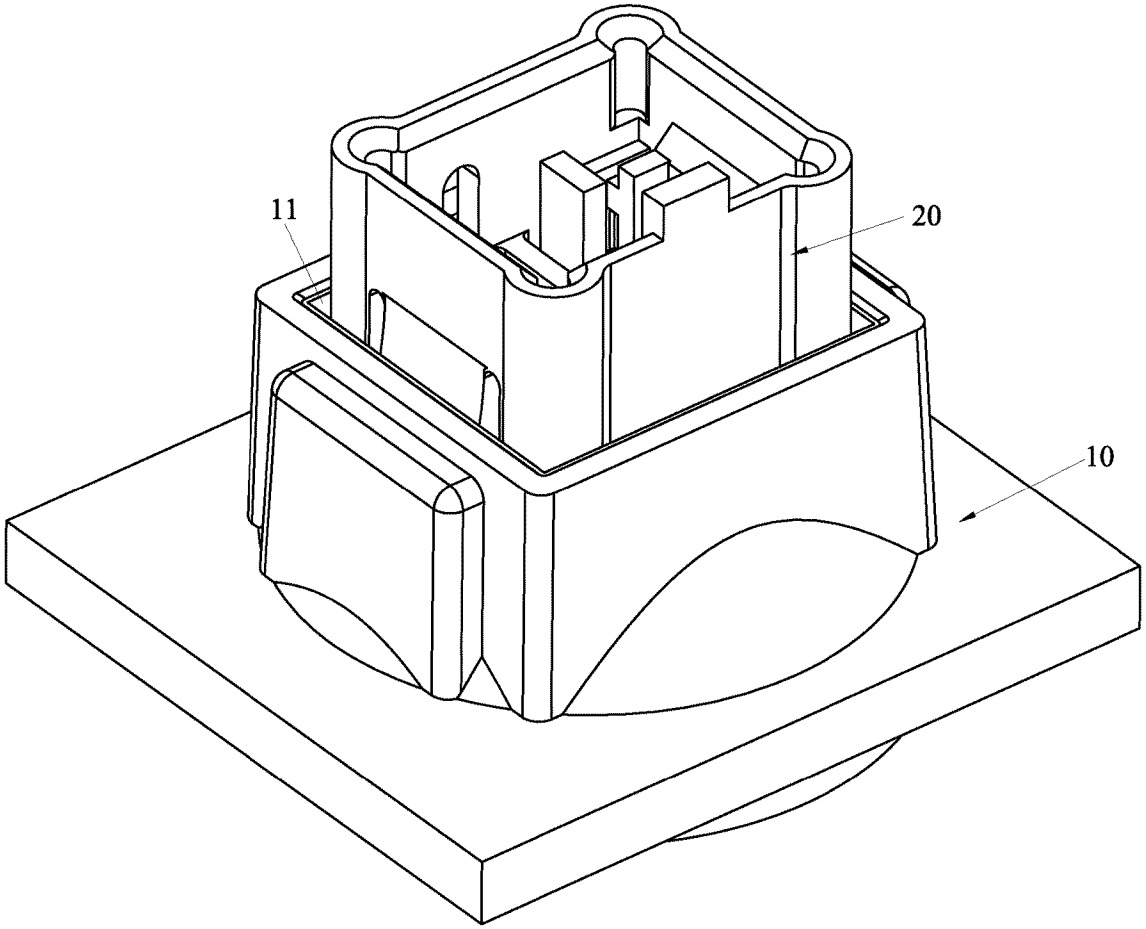
FIG. 1 is a perspective view according to a first embodiment of the present invention.
Figure 2:
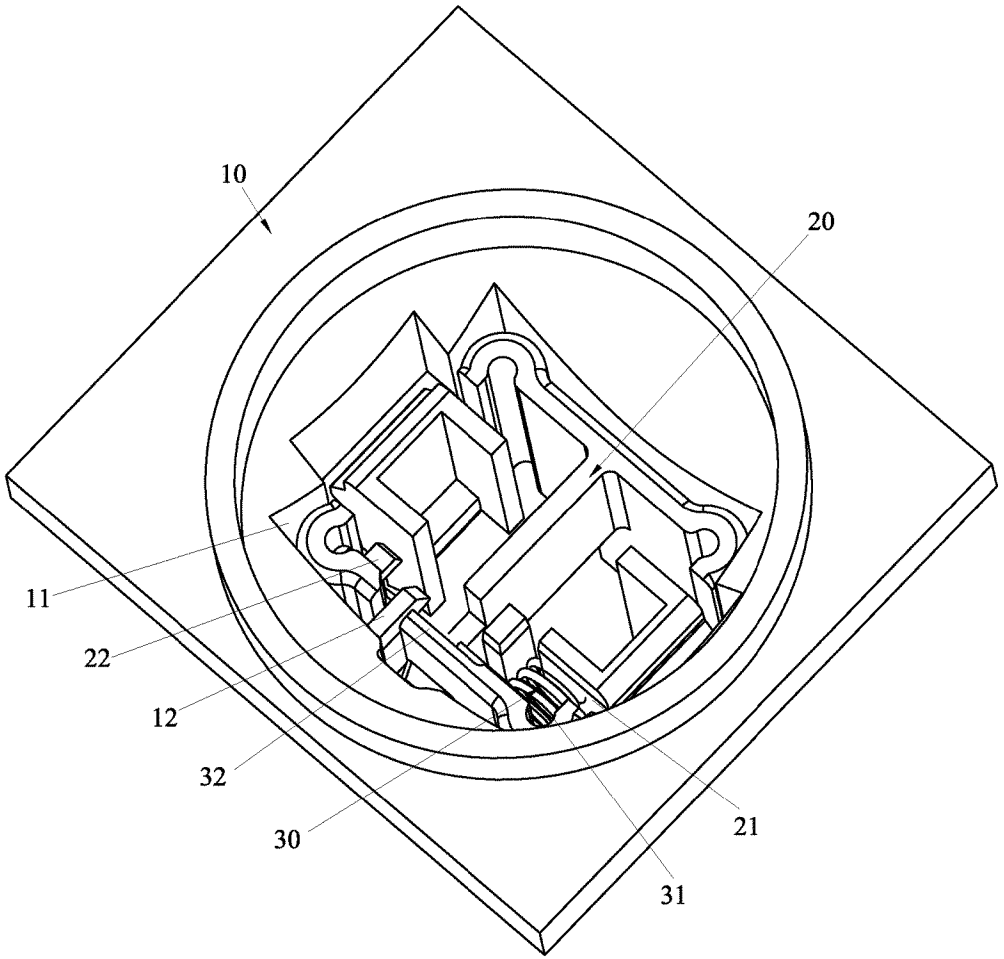
FIG. 2 is another perspective view according to the first embodiment of the present invention seen from another angle.
Figure 3:
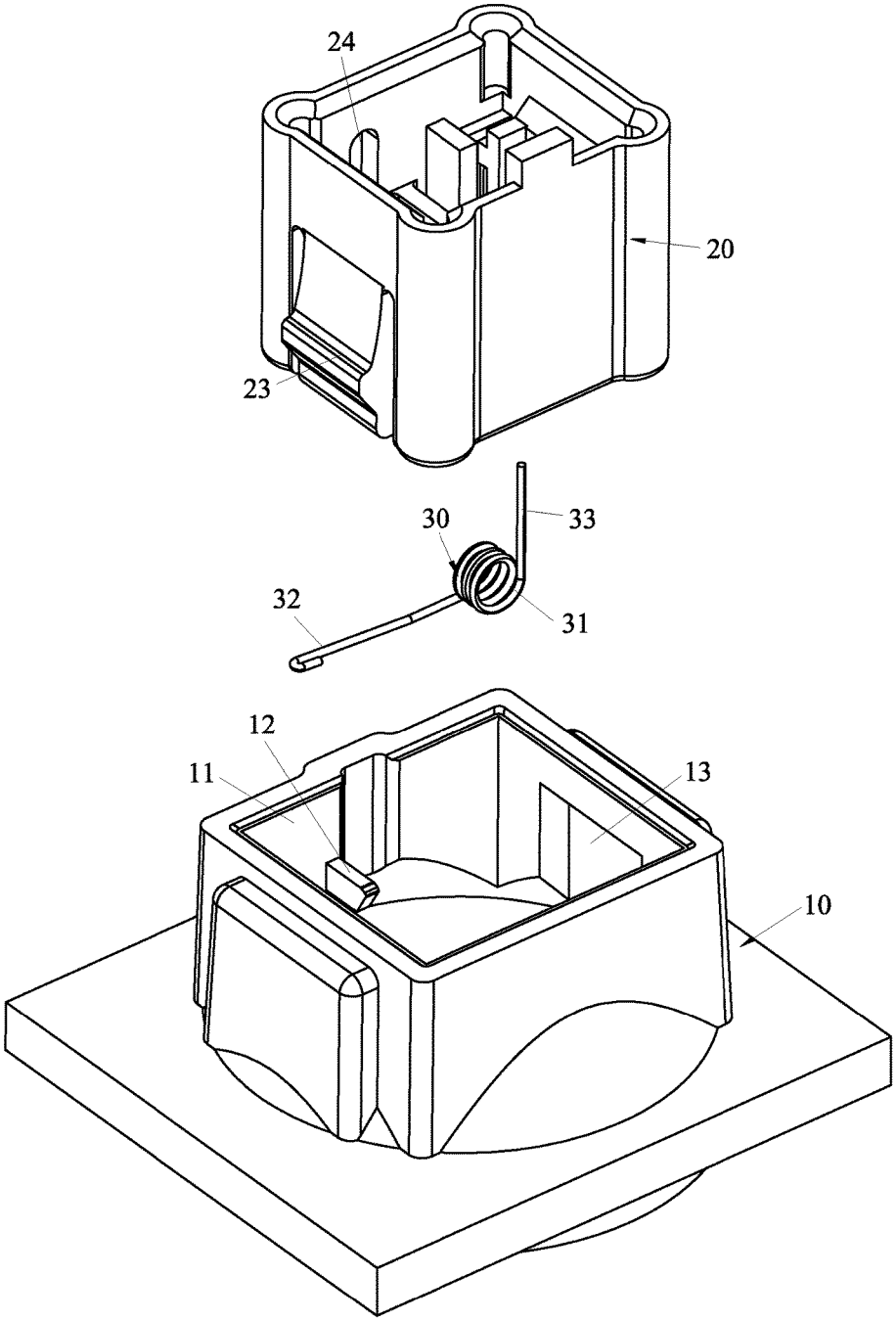
FIG. 3 is an exploded view according to the first embodiment of the present invention.

Embodiments of the present invention will now be described, by way of example only, with reference to the accompanying drawings.

As shown in FIG. 1 to FIG. 4, a first embodiment of the present invention comprises a seat 10 and a press block 20.

The press block 20 is movably insertedly mounted in the seat 10. The seat 10 includes a silicone rubber member 45 therein for pushing the press block 20 to move up and down. The seat 10 or the press block 20 is provided with a torsion spring 30 for pushing the press block 20 to move up and for hitting the seat 10 or the press block 20 to produce a sound.

Specifically, in this embodiment, the seat 10 is formed with a through hole 11 penetrating upper and lower surfaces thereof. The press block 20 is located in the through hole 11. An inner wall of the through hole 11 is provided with a holding portion 12. The bottom of the press block 20 is formed with a spring room 21. The press block 20 has a hit portion 22 therein. The hit portion 22 and the spring room 21 are located at two sides of the holding portion 12, respectively. The torsion spring 30 includes a main body portion 31, a drive arm 32, and a driven arm 33. The main body portion 31 is connected between the drive arm 32 and the driven arm 33. The main body portion 31 and the driven arm 33 are placed in the spring room 21. The drive arm 32 leans against the holding portion 12. A distal end of the drive arm 32 is located above the hit portion 22.

The inner wall of the through hole 11 is provided with a guide limit recess 13. An outer wall of a lower end of the press block 20 is provided with a raised guide limit portion 23. The guide limit portion 23 is located in the guide limit recess 13 and moved up and down along the guide limit recess 13. One side of the press block 20 is provided with a positioning groove 24. The holding portion 12 passes through the positioning groove 24 and extends into the press block 20. The holding portion 12 is moved up and down along the positioning groove 24.

Figure 4:
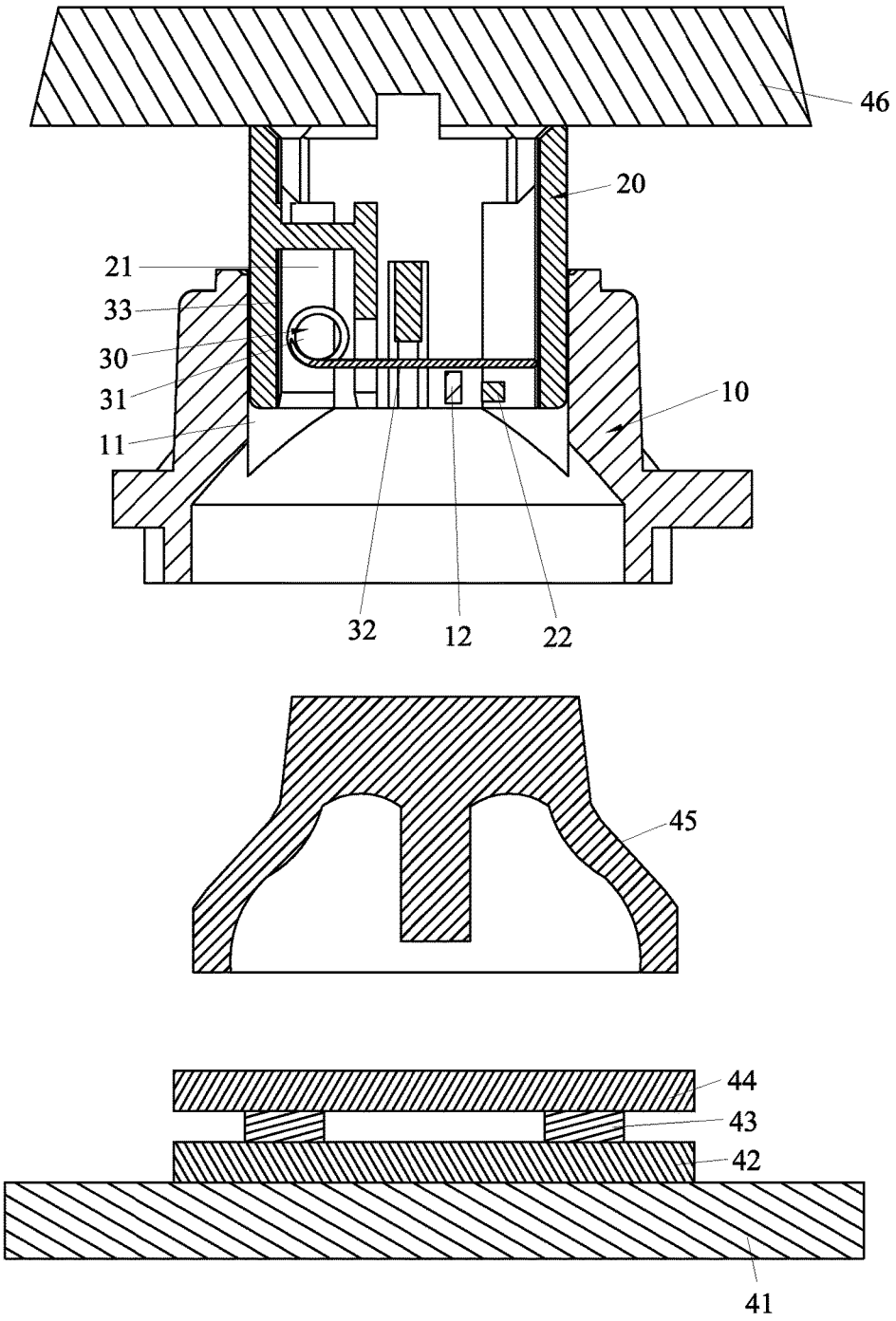
FIG. 4 is a sectional view according to the first embodiment of the present invention in a use state.

When in use, the present invention is mounted on a silicone keyboard. As shown in FIG. 4, the surface of a light-emitting panel 41 is successively stacked with a lower conductive sheet 42, a separator 43, and an upper conductive sheet 44. The silicone rubber member 45 is disposed above the upper conductive sheet 44. The present invention is disposed on the silicone rubber member 45. A key cap 46 is provided on top of the press block 12. When the press block 20 is not pressed, the drive arm 32 is in a horizontal state. When the press block 20 is pressed down, the torsion spring 30 is pressed down by the press block 20, and the drive arm 32 is blocked by the holding portion 12 to deform upward. After the press block 20 is pressed down for a predetermined stroke, the drive arm 32 disengages from the holding portion 12. At this time, the drive arm 32 is restored to move downward and hit the hit portion 22 to produce a sound. When the press block 20 is released, the press block 20 is pushed by the silicone rubber member 45, and the drive arm 32 is restored to be above the holding portion 12 and produce a sound, thereby judging the key in an opened or closed state.

Figure 5:
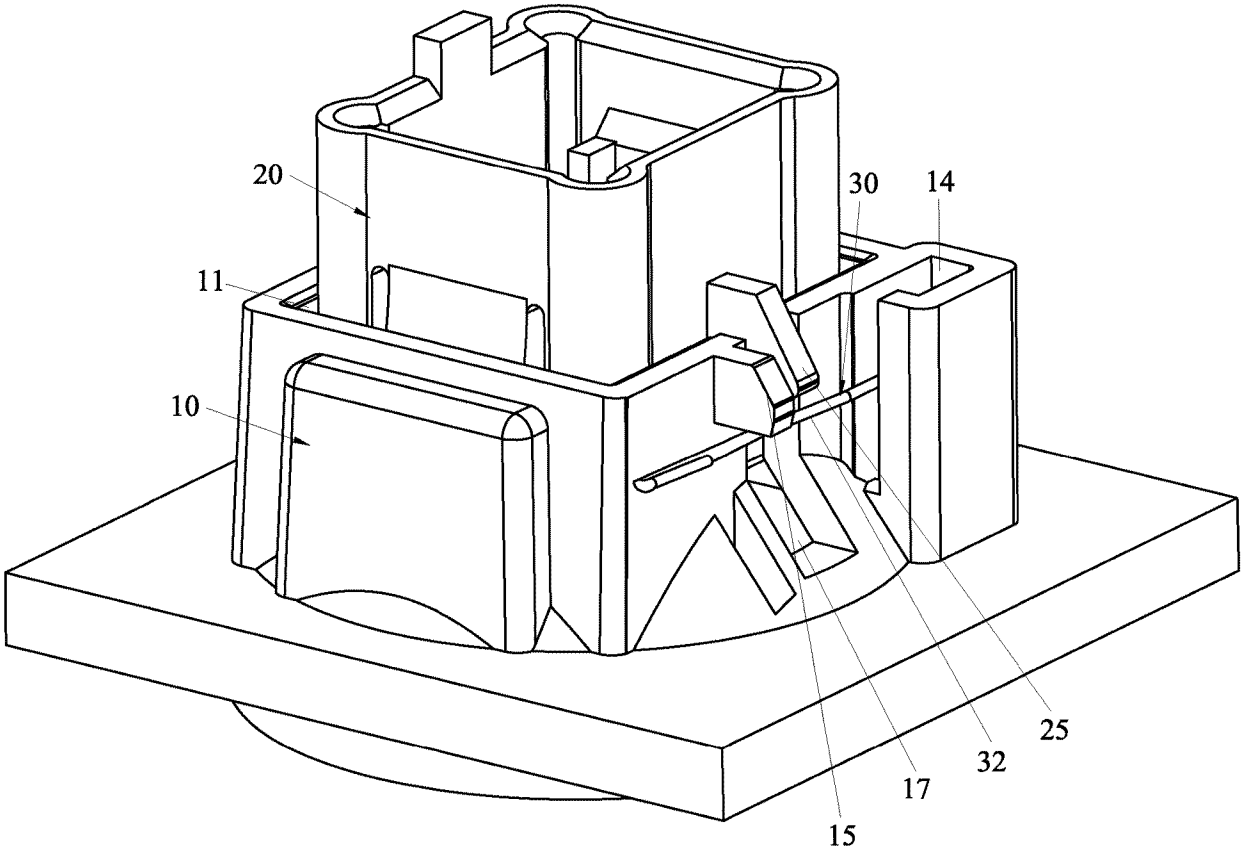
FIG. 5 a perspective view according to a second embodiment of the present invention.
Figure 6:
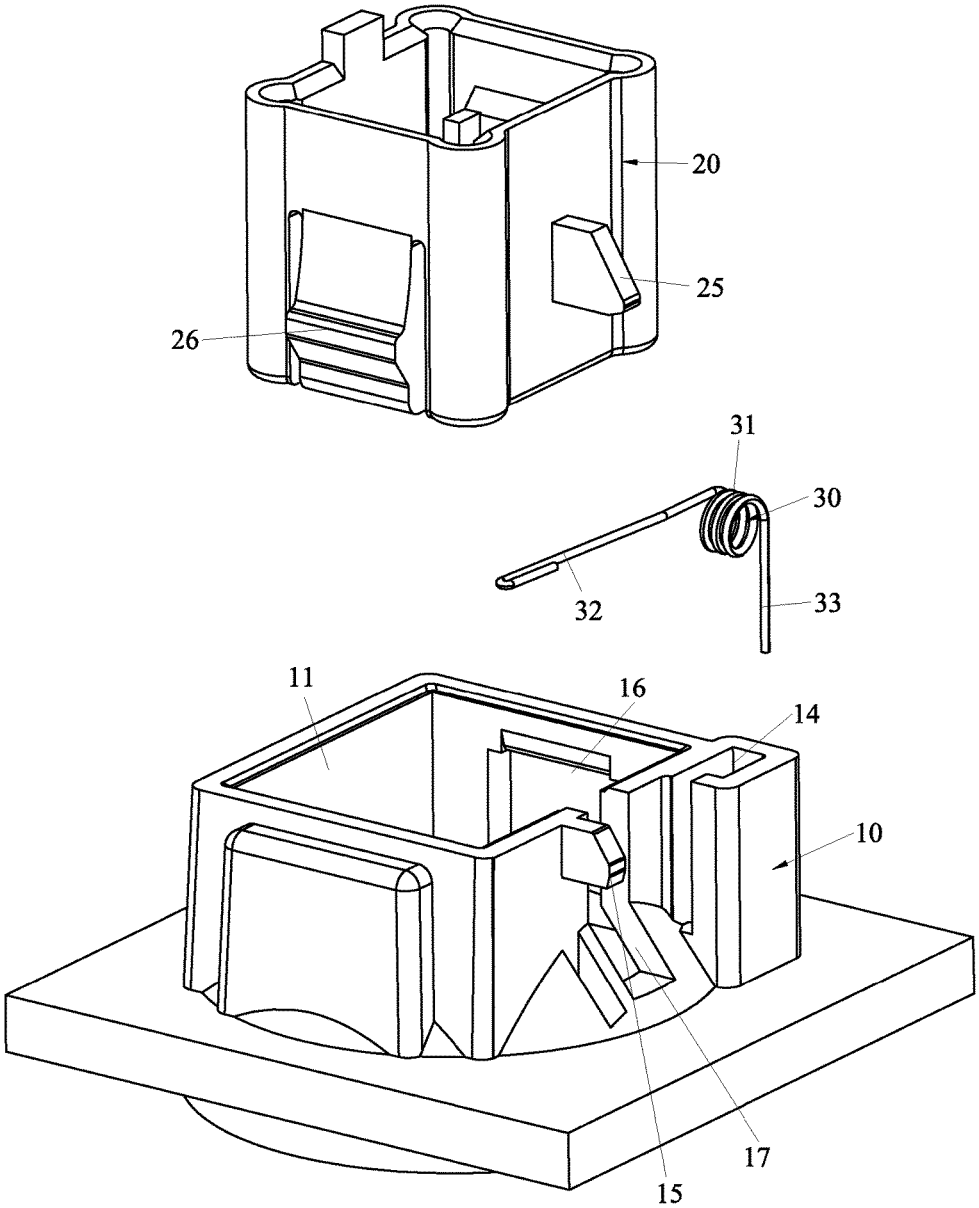
FIG. 6 is an exploded view according to the second embodiment of the present invention.
Figure 7:
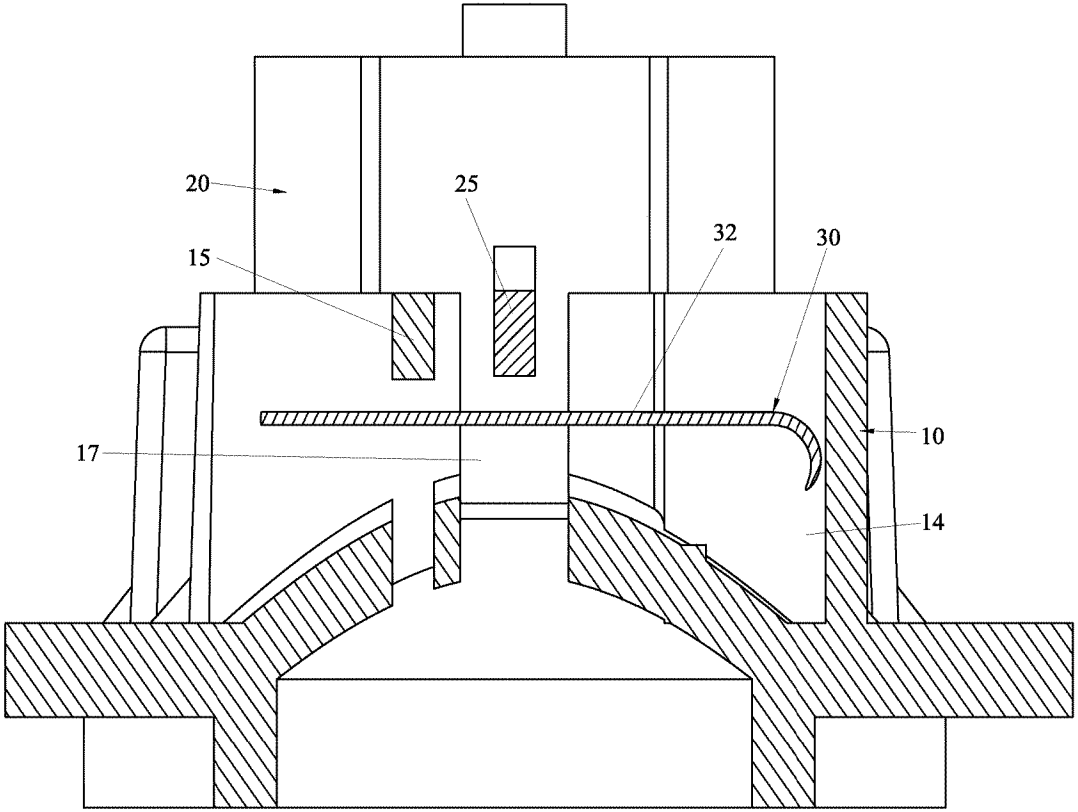
FIG. 7 is a sectional view according to the second embodiment of the present invention in a use state.

FIGS. 5 to 7 illustrate a second embodiment which is substantially similar to the first embodiment with the exceptions described hereinafter.

In this embodiment, the seat 10 is formed with a through hole 11 penetrating upper and lower surfaces thereof. The press block 20 is located in the through hole 11. The seat 10 is provided with a spring room 14 and a hit portion 15. An outer wall of the press block 20 is provided with a holding portion 25. The spring room 14 and the hit portion 15 are located at two sides of the holding portion 25, respectively. The torsion spring 30 includes a main body portion 31, a drive arm 32, and a driven arm 33. The main body portion 31 is connected between the drive arm 32 and the driven arm 33. The main body portion 31 and the driven arm 33 are placed in the spring room 14. The drive arm 32 leans against a bottom surface of the holding portion 25. A distal end of the drive arm 32 is located under the hit portion 15. An inner wall of the through hole 11 is provided with a guide limit recess 16. An outer wall of a lower end of the press block 20 is provided with a raised guide limit portion 26. The guide limit portion 26 is located in the guide limit recess 16 and moved up and down along the guide limit recess 16. One side of the seat 10 is provided with a positioning groove 17. The holding portion 25 passes through the positioning groove 17 and extends out of the seat 10. The holding portion 25 is moved up and down along the positioning groove 17.

When the press block 20 is not pressed, the drive arm 32 is in a horizontal state. When the press block 20 is pressed down, the drive arm 32 is pressed down by the holding portion 25 to deform downward. After the press block 20 is pressed down for a predetermined stroke, the drive arm 32 disengages from the holding portion 25. At this time, the drive arm 32 is restored to move upward and hit the hit portion 15 to produce a sound. When the press block 20 is released, the press block 20 is pushed by the silicone rubber member 45, and the drive arm 32 is restored to be under the holding portion 25 and produce a sound, thereby judging the key in an opened or closed state.

The feature of the present invention is that the seat or the press block is provided with the torsion spring. The press block is biased by the torsion spring to move up so that the product has better handfeel. Meanwhile, when the press block is pressed or released, the torsion spring hits the seat or the press block to produce a sound, providing a better auditory effect. It is more convenient for use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A key sound generation device for a silicone keyboard, comprising a seat and a press block; the press block being movably insertedly mounted in the seat, characterized by: the seat including a silicone rubber member therein for pushing the press block to move up and down, the seat or the press block being provided with a torsion spring for pushing the press block to move up and for hitting the seat or the press block to produce a sound, wherein the seat is formed with a through hole penetrating upper and lower surfaces thereof, the press block is located in the through hole, an inner wall of the through hole is provided with a holding portion, a bottom of the press block is formed with a spring room, the press block has a hit portion therein, the hit portion and the spring room are located at two sides of the holding portion respectively, the torsion spring includes a main body portion, a drive arm, and a driven arm, the main body portion is connected between the drive arm and the driven arm, the main body portion and the driven arm are placed in the spring room, the drive arm leans against the holding portion, and a distal end of the drive arm is located above the hit portion.

2. The key sound generation device for a silicone keyboard as claimed in claim 1, wherein the inner wall of the through hole is provided with a guide limit recess, an outer wall of a lower end of the press block is provided with a raised guide limit portion, the guide limit portion is located in the guide limit recess and moved up and down along the guide limit recess.

3. The key sound generation device for a silicone keyboard as claimed in claim 1, wherein one side of the press block is provided with a positioning groove, the holding portion passes through the positioning groove and extends into the press block, and the holding portion is moved up and down along the positioning groove.

4. The key sound generation device for a silicone keyboard as claimed in claim 1, wherein the seat is formed with a through hole penetrating upper and lower surfaces thereof, the seat is provided with a spring room and a hit portion; the press block is located in the through hole, an outer wall of the press block is provided with a holding portion, the spring room and the hit portion are located at two sides of the holding portion respectively; the torsion spring includes a main body portion, a drive arm, and a driven arm, the main body portion is connected between the drive arm and the driven arm, the main body portion and the driven arm are placed in the spring room, the drive arm leans against a bottom surface of the holding portion, and a distal end of the drive arm is located under the hit portion.

5. The key sound generation device for a silicone keyboard as claimed in claim 4, wherein an inner wall of the through hole is provided with a guide limit recess, an outer wall of a lower end of the press block is provided with a raised guide limit portion, the guide limit portion is located in the guide limit recess and moved up and down along the guide limit recess.

6. The key sound generation device for a silicone keyboard as claimed in claim 4, wherein one side of the seat is provided with a positioning groove, the holding portion passes through the positioning groove and extends out of the seat, and the holding portion is moved up and down along the positioning groove.

* * * * *